US006132249A

United States Patent [19]

Saito et al.

[11] Patent Number: 6,132,249

[45] **Date of Patent: *Oct. 17, 2000**

[54] REAR HOLDER FOR WATERPROOF CONNECTOR AND METHOD OF PRODUCING THE SAME

[75] Inventors: Hitoshi Saito; Hisashi Tsukamoto, both of Shizuoka, Japan

[73] Assignee: Yazaki Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/120,465

[22] Filed: Jul. 23, 1998

[30] Foreign Application Priority Data

Jul. 24, 1997 [JP] Japan ..... 9-198262

[51] Int. Cl.[7] ..... H01R 13/40

[52] U.S. Cl. ..... 439/587; 439/274

[58] Field of Search ..... 439/587, 589, 439/274, 275, 279

[56] References Cited

U.S. PATENT DOCUMENTS 4,895,533 1/1990 Yagi et al. ..... 439/587
5,395,266 3/1995 Abe et al. ..... 439/587
5,618,198 4/1997 Sato et al. ..... 439/274

FOREIGN PATENT DOCUMENTS 60-133587 9/1985 Japan .
8-96883 4/1996 Japan .

*Primary Examiner*—Tulsidas C Patel
*Attorney, Agent, or Firm*—Armstrong, Westerman, Hattori, McLeland & Naughton

[57] ABSTRACT

A rear holder for a waterproof connector which causes no short shots is provided. The metal mold for forming this rear holder is easy to produce. The rear holder includes a resin material member and a rubber material member. The resin material member is provided with a plate-like holding member substantially in parallel with the terminal insertion side end face thereof. Holder terminal insertion holes and holder connecting holes penetrate through the plate-like holding member. The rubber material member is made up of a front portion, a rear portion, and a connecting portion. The front portion and the rear portion are separated from each other by the plate-like holding member of the resin material member, and are connected by the connecting portion that penetrates through the holder connecting holes of the resin material member. A front rubber member terminal insertion hole and a rear rubber member terminal insertion hole penetrate through the front portion and the rear portion, respectively, and communicate with the holder terminal insertion holes of the resin material member.

3 Claims, 7 Drawing Sheets

FIG. 2B1
α
1
2(2a)
2(2b)
II
2
1a
1e
2e
2a1
2d
2a
1c
2b1
2b
2c1
2c
2f

REAR HOLDER FOR WATERPROOF CONNECTOR AND METHOD OF PRODUCING THE SAME

BACKGROUND OF THE INVENTION

1. Field of the Invention

The present invention relates to a rear holder for a waterproof connector.

2. Related Art

A waterproof connector is used for electric connection in various products such as motorcycles. A waterproof connector is roughly made up of a connector main body for connecting to a mating waterproof connector, and a rear holder for holding a wire connected to a terminal inserted into the connector on the terminal insertion side and for preventing water from entering from the terminal insertion side.

Japanese Utility Model Application No. 59-19747 (or Japanese Utility Model Laid Open No. 60-133587), also filed by the present applicant, discloses a rear holder θ shown in FIG. 5B (as seen from the mating housing). A rubber material member 52 is obtained by insert-molding a rubber forming material into a stopper frame 51 made of resin as shown in the perspective view of FIG. 5A. Reference numeral 53 indicates wire insertion holes.

FIG. 5C shows the rear holder θ taken along the line V—V of FIG. 5B. In FIG. 5D, the rear holder θ is attached to a connector main body 55, and a terminal 62 connected to a wire 61 is being inserted into one of the wire insertion holes 53.

The wire insertion hole 53 is made small for a waterproof purpose, and the terminal 62 is often tilted against the insertion direction when inserted into the wire insertion hole 53. At this point, the rubber material member 52 made of an elastic material does not have enough straightening ability. As can be seen from the figure, the edge of the terminal 62 is brought into contact with the wall end face of the connector receiving chamber 56 at the point indicated by the arrow, thus hindering terminal insertion.

With the rear holder θ disclosed in Japanese Utility Model Application No. 59-19747, there has been a problem that workability in terminal insertion is very low in automatic connector insertion.

To solve such problem, Japanese Patent Application Laid-Open No. 8-96883 discloses a rear holder as follows.

FIG. 6A shows the rear holder L as seen from the terminal insertion side. FIG. 6B is a side view of the rear holder L. FIG. 6C shows the rear holder L as seen from the mating connector. FIG. 7A is a sectional view taken along the line VI—VI of FIG. 6A, and FIG. 7B is a sectional view taken along the line VI'—VI' of FIG. 6C.

As the inlet portion 74 of a wire insertion hole 73 of the rear holder L is made of resin and capable of preventing and correcting terminal tilt caused at the time of terminal insertion, workability in terminal insertion is excellent. However, there is a problem with a metal mold used for forming the rubber material member 72 of the rear holder L.

FIG. 7C shows a resin material member 71 prior to the rubber material member 72 of the rear holder L as seen from the terminal insertion side.

Reference numeral 71*c* indicates connecting holes for supplying a raw material from a rubber material holder forming portion 71*b*, which forms a rubber material holder 72*b* at the time of forming the rubber material member 72, to a lip portion 72*a* of the rubber material member 72. After the formation of the rubber material member 72, a connecting portion 72*c* is formed, and the rubber material holder 72*b* and the lip portion 72*a* are connected so as to integrally form the rubber material member 72. The resin material member 71 is first formed and inserted into a cavity of a metal mold used for forming the rubber material member. A rubber forming material is then introduced from the side of the rubber material holder 72*b*. The rubber forming material is thus supplied to the lip portion 72*a* from a gate (not shown) through the connecting holes 71*c* formed in the resin material member 71.

However, since an inlet portion 74 of each wire insertion hole 73 is situated on the side of the rubber material holder 72*b*, and the edge of the flow of the rubber member forming material becomes solidified due to the heat generated during the detour to avoid the inlet portion 74. As a result, a short shot is caused. Many short shots are caused in forming a rubber member of a multipolar connector with a more complicated detour. If the inlet portion 74 has a rectangular shape instead of a circular shape, even more short shots are caused, resulting in a sharp decrease in production yield. The number of occurrences of such short shots can be reduced to some extent by increasing the number of gates of the rubber member forming metal mold. However, this often makes the metal mold structure more complicated, and increases the production costs of the metal mold.

For the metal mold to produce the rubber material member 72, it is necessary to contrive to form the portion surrounded by the two-dot chain line of FIG. 7C. To prevent burrs during the formation of the rubber material member 72, a rubber material member forming metal mold 80 needs to be provided with a protrusion 81 which is in contact with the end face on the terminal insertion side in the vicinity of the inlet portion 74 of the terminal insertion hole 73 and the rubber material member holder forming portion 71*b* (the portion in contact with such metal mold protrusion is indicated by the two-dot chain line in FIG. 7C). Providing the protrusion 81 to the metal mold 80 sharply increases the production costs, and is more time-consuming. This has been a big problem especially in manufacturing a multipolar connector rear holder.

SUMMARY OF THE INVENTION

The principal object of the present invention is to provide a rear holder for a waterproof connector with no short shots. A metal mold for forming the rear holder is easy to produce.

The rear holder of the present invention comprises a resin material member and a rear material member. The resin material member is provided with a plate-like holding member substantially in parallel with the terminal insertion side end face. The plate-like holding member is provided with holder terminal insertion holes and holder connecting holes which penetrate the holding member. The rubber material member is made up of a front portion, a rear portion, and a connecting portion. The front portion and the rear portion are separated from each other by the plate-like holding member, and connected to each other by the connecting portion that penetrates through the holder connecting holes of the resin material member. The front portion and the rear portion are provided with front rubber member terminal insertion holes and rear rubber member terminal insertion holes, respectively, which communicate with the holder terminal insertion holes of the resin material member.

The method of producing the rear holder of the present invention includes the steps of: providing the resin material member with a plate-like holding member substantially parallel with the terminal insertion side end face; forming holder terminal insertion holes and holder connecting holes penetrating through the plate-like holding member, placing the resin material member in a cavity of a metal mold; introducing a rubber forming material to the other side of the plate-like holding member through the holder connecting holes; forming a rubber material member which is divided into a front portion and a rear portion by the plate-like holding member of the resin material member and connected to each other by a connecting portion penetrating through the holder connecting holes of the resin material member; and providing the rubber material member with a front rubber member terminal insertion hole and a rear rubber member terminal insertion hole which penetrate through the holder terminal insertion holes of the resin material member.

The above and other objects and features of the present invention will be more apparent from the following description taken in conjunction with the accompanying drawings.

DETAILED DESCRIPTION OF THE PREFERRED EMBODIMENTS

Figure 1C:
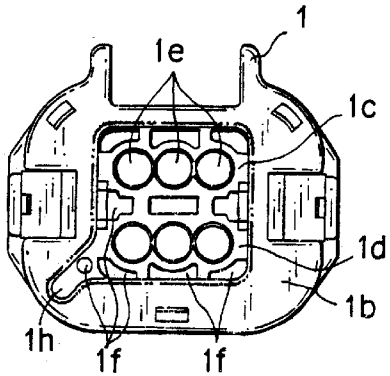
FIG. 1C shows the resin material member 1 as seen from the terminal insertion side.
Figure 1B:
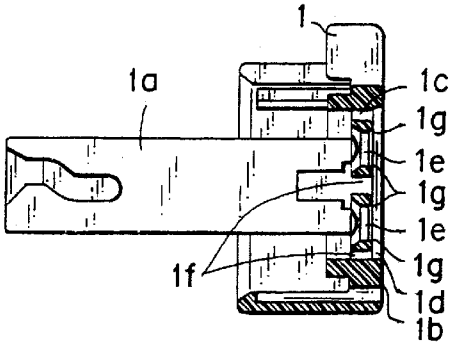
FIG. 1B is a sectional view taken along the line of I—I of FIG. 1A.
Figure 1D:
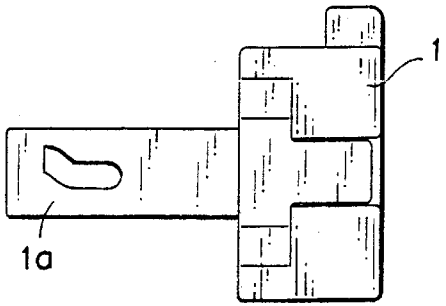
FIG. 1D is a side view of the resin material member 1.
Figure 1A:
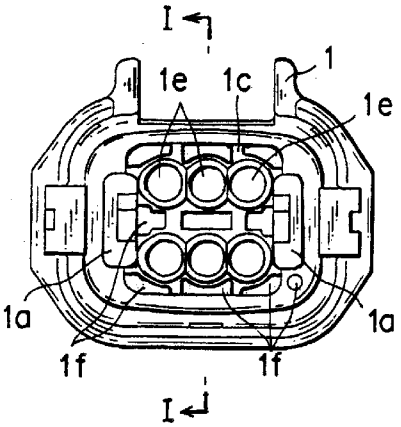
FIG. 1A shows a resin material member 1 of a rear holder α for a waterproof connector of the present invention as seen from a mating connector.
Figure 1E:
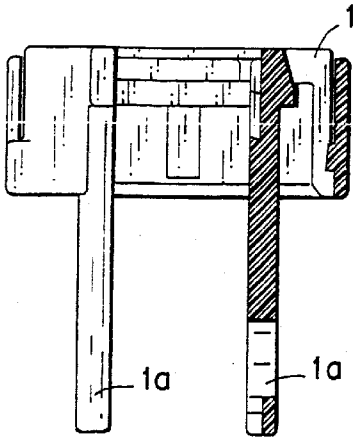
FIG. 1E is a partially sectional top view of the resin material member 1.

The following is a detailed description of an embodiment of a rear holder α for a waterproof connector of the present invention, with reference to the accompanying drawings.

FIGS. 1A to 1E show a resin material member 1 of the rear holder α for a waterproof connector of the present invention. In FIGS. 1A to 1E, reference numeral 1*a* indicates a stopper used for connecting and stopping a connector portion (not shown).

The resin material member 1 of the rear holder α is provided with a plate-like holding member 1*c* which is situated in parallel with a terminal insertion side end face 1*b*, and a rubber floating portion 1*d*. Since the holding member 1*c* has no convex on the terminal insertion side, it cannot prevent a rubber forming material from flowing through the rubber floating portion 1*d*, as described later.

The holding member 1*c* has holder terminal insertion holes 1*e* and holder connecting holes 1*f*, both penetrating through the holding member 1*c*. The rim of the inlet of each holder terminal insertion hole 1*e* is diagonally cut, and provided with a guide portion 1*g* for introducing a terminal into each holder terminal insertion hole 1*e*.

The following is a description of another embodiment of the rear holder α having a rubber material member 2 formed with the resin material member as an insert.

FIGS. 2A to 2E show the rear holder α for a waterproof connector in accordance with the present invention. The rubber material member 2 consists of a front portion 2*a*, a rear portion 2*b* and a connecting portion 2*c*. The front portion 2*a* and the rear portion 2*b* are separated from each other by the plate-like holding member 1*c* of the resin material member 1, and connected to each other by the connecting portion 2*c* situated inside the holder connecting holes 1*f* of the resin material member 1. By virtue of this connection, the front portion 2*a* and the rear portion 2*b* are both prevented from slipping off.

The front portion 2*a* and the rear portion 2*b* are provided with front rubber member terminal insertion holes 2*a*1 and rear rubber member terminal insertion holes 2*b*1, respectively. Both terminal insertion holes 2*a*1 and 2*b*1 communicate with the holder terminal insertion holes 1*e* of the resin material member 1.

The front portion 2*a* serves as a waterproof portion on the connector main portion (not shown), and is provided with a connector lip 2*d*. Inside each front rubber member terminal insertion hole 2*a*1, a wire lip 2*e* is provided for forming a waterproof structure with a wire connected to a terminal accommodated inside a waterproof connector terminal chamber. With the rear holder α, the diameter of each holder terminal insertion hole 1*e* is made larger than the pin to be inserted, and a rubber layer 2*f* is formed for connecting the rubber material member front portion 2*a* and the rear portion 2*b* to the inner surface of each insertion hole 1*e*, so as to prevent the rubber forming material from entering the inside of the holder terminal insertion holes 1*e* of the resin material member. The rubber layer 2*f* is thin enough to allow each holder terminal insertion hole 1*e* to prevent the terminal from titling at the time of terminal insertion. Accordingly, the use of such rear holder α can dramatically improve the workability in inserting the terminal into a waterproof connector.

The following is an explanation of the method of producing the rear holder α for a waterproof connector in accordance with the present invention.

First, the resin material 1 shown in FIGS. 1A to 1E is produced by a conventional injection molding method.

Figure 3A:
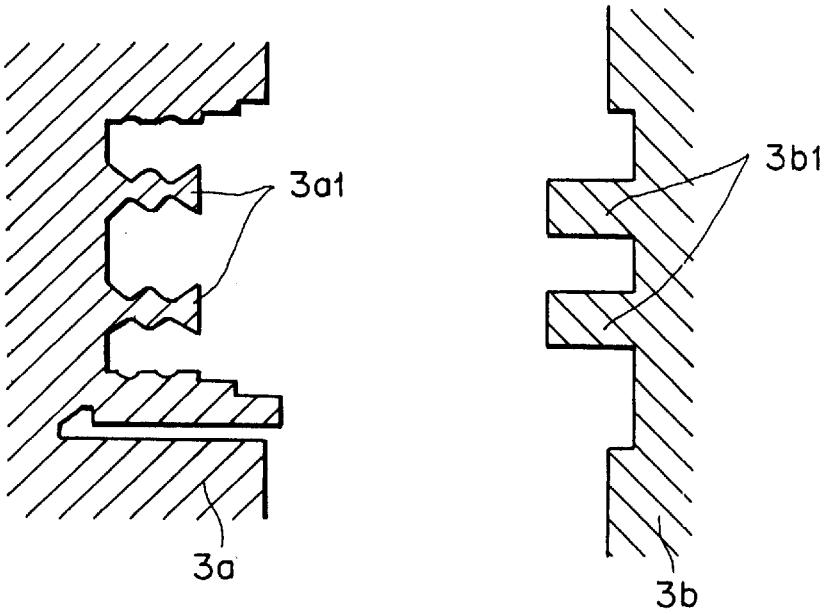
FIG. 3A is a sectional view of a metal mold used in the method of producing the rubber material member of the rear holder α of the waterproof connector of the present invention.
Figure 3B:
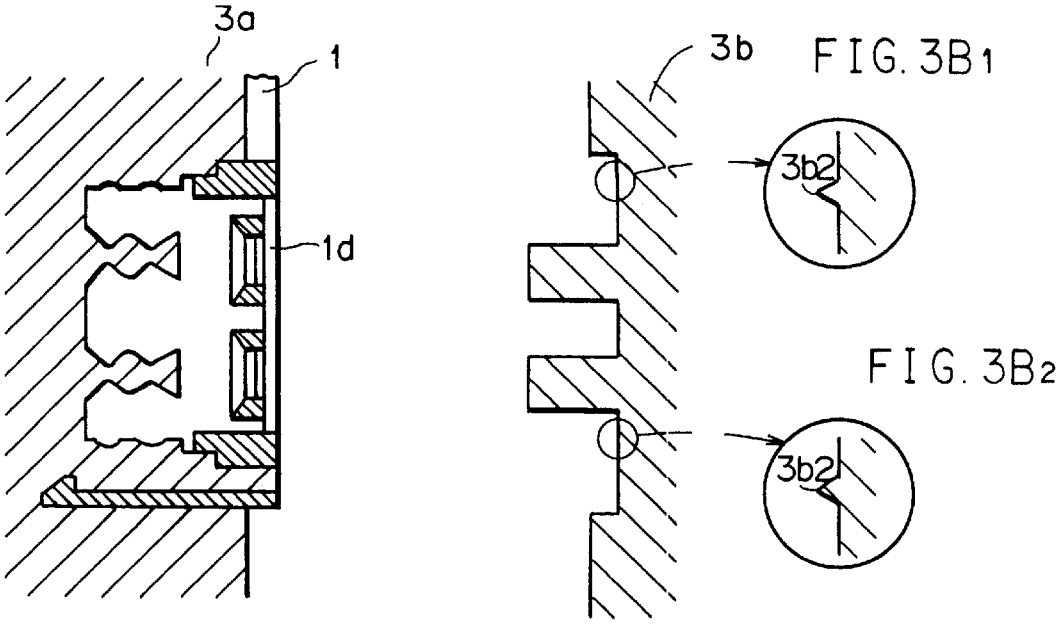
FIG. 3B shows the metal mold with the resin material member.

As shown in FIG. 3B, the resin material 1 is then set to a rubber material member forming metal mold 3*a* (a fixed mold) shown in FIG. 3A. Reference numerals 3*a*1 and 3*b*1 indicate insertion hole forming pins. A rubber material member forming metal mold 3*b* (a movable mold) is provided with burr preventing protrusions 3*b*2 which are brought into contact with the terminal insertion end face of the resin material member 1 at the time of clamping. More specifically, the protrusions 3*b*2 are brought into contact with the portion indicated by a two-dot chain line in FIG. 1C. The burr preventing protrusions 3*b*2 are necessary in only one region, as shown in FIG. 1C, because the plate-like holding member 1*c* in parallel with the terminal insertion side end face 1*b* of the resin material member 1 does not actually reach the end face 1*b*.

Figure 4A:
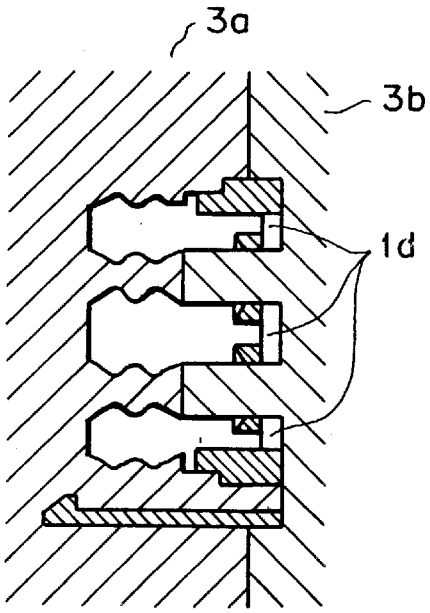
FIG. 4A shows a clamped state in the method of producing the rubber material member of the rear holder α of the waterproof connector of the present invention.
Figure 4B:
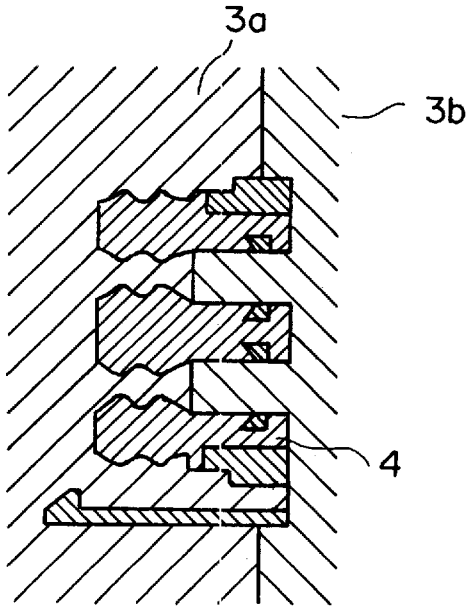
FIG. 4B shows a situation in which the rubber forming material 4 is introduced into a cavity through a gate portion.

As shown in FIG. 4A, clamping is performed, and a rubber forming material 4 is introduced from a gate 1*h* shown in FIG. 1C into the cavity portion (see FIG. 4B). By virtue of the burr preventing protrusions 3*b*2, the terminal insertion side end face can be free of burrs.

Figure 4C:
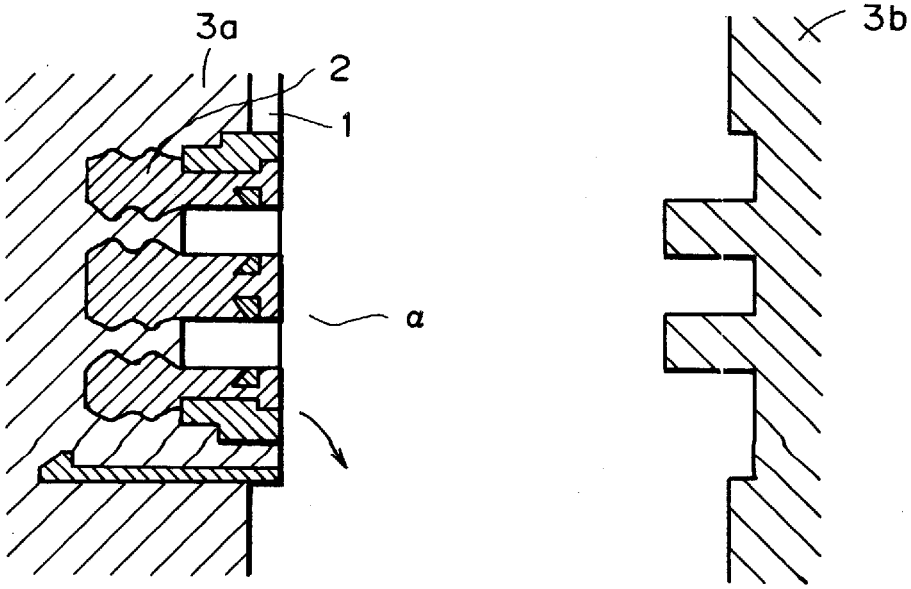
FIG. 4C shows a situation in which the mold is opened to remove the rear holder α.
Figure 5A:
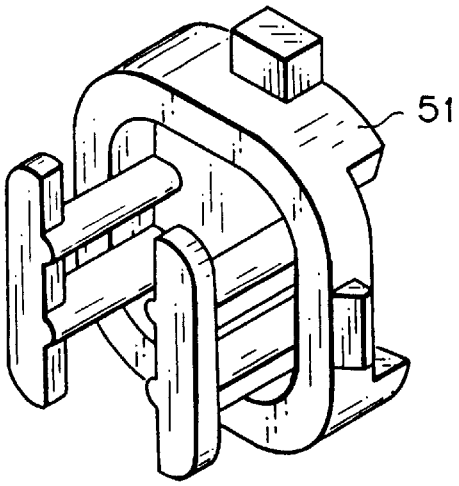
FIG. 5A PRIOR ART
FIG. 5A is a perspective view of a prior art stopper frame.
Figure 5B:
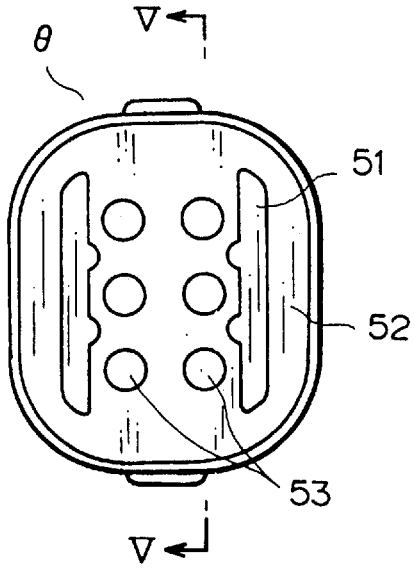
FIG. 5B PRIOR ART
FIG. 5B shows the stopper frame with a rubber member formed on it.
Figure 5C:
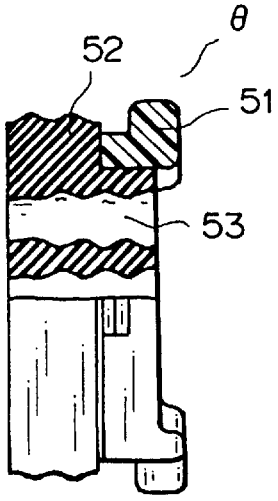
FIG. 5C PRIOR ART
FIG. 5C is a sectional view taken along the line V—V of FIG. 5B.
Figure 5D:
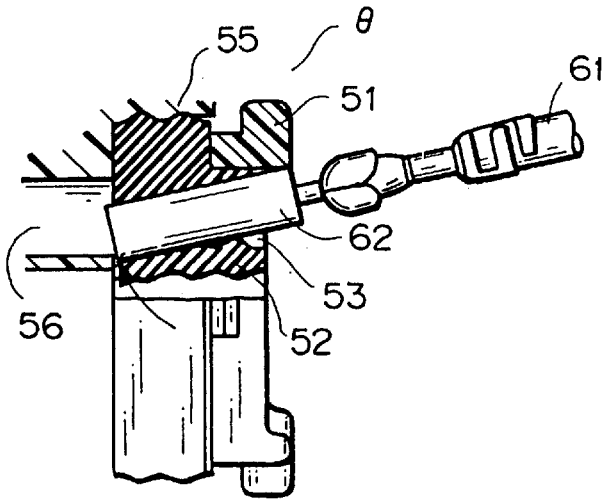
FIG. 5D PRIOR ART
FIG. 5D shows a situation in which a rear holder θ is inserted into a connector main portion 55, and a terminal 62 connected to a wire 61 is being inserted into a wire insertion hole 53.
Figure 6A:
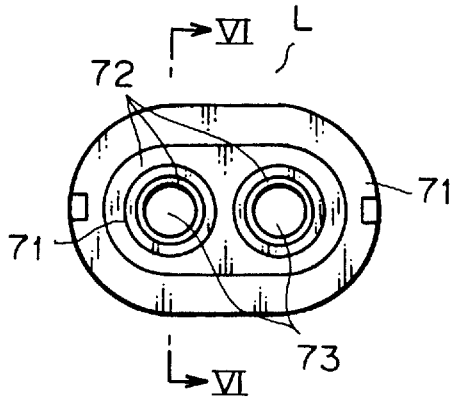
FIG. 6A PRIOR ART
FIG. 6A shows a rear holder L of the prior art as seen from the terminal insertion side.
Figure 6B:
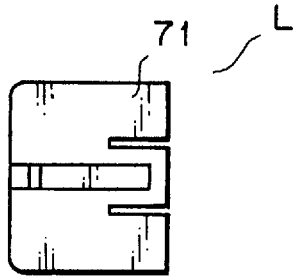
FIG. 6B PRIOR ART
FIG. 6B is a side view of the rear holder L.
Figure 6C:
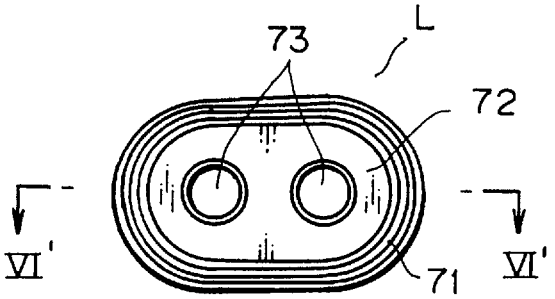
FIG. 6C PRIOR ART
FIG. 6C shows the rear holder L as seen from the mating connector.
Figure 7A:
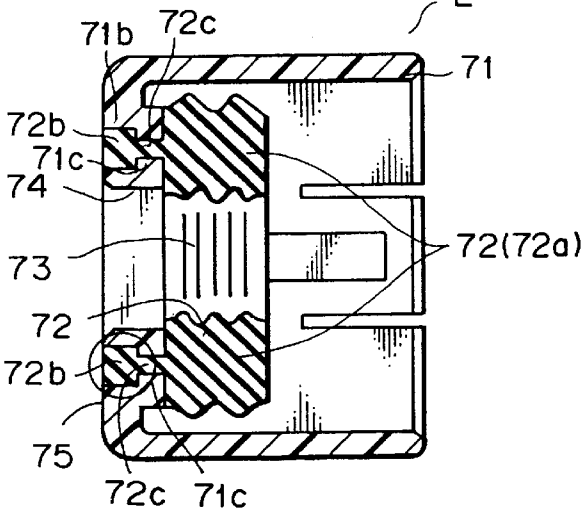
FIG. 7A PRIOR ART
FIG. 7A is a sectional view of the rear holder L taken along the line VI—VI of FIG. 6A.
Figure 7B:
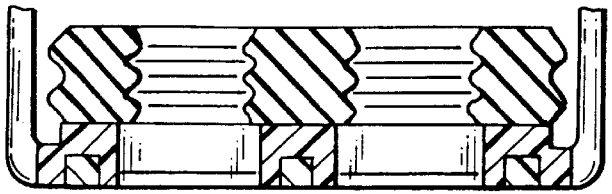
FIG. 7B PRIOR ART
FIG. 7B is a sectional view of the rear holder L taken along the line VI'—VI' of FIG. 6C.
Figure 7C:
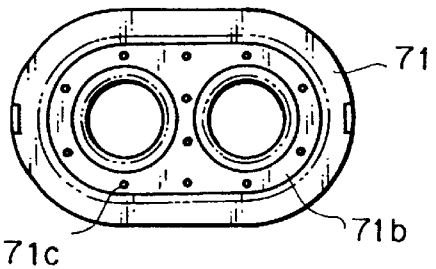
FIG. 7C PRIOR ART
FIG. 7C shows the resin material member of the rear holder L.
Figure 7D:
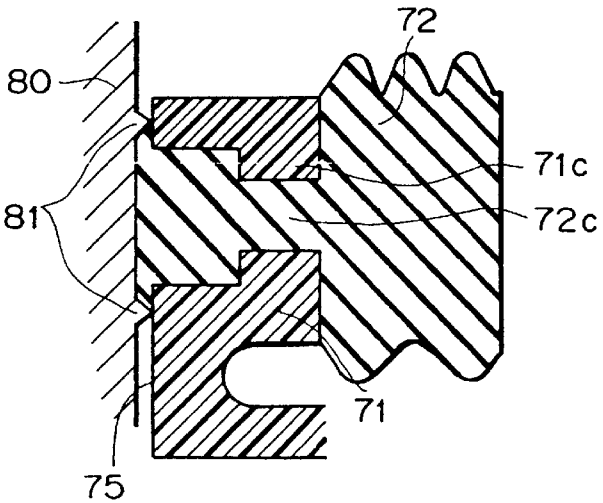
FIG. 7D PRIOR ART
FIG. 7D shows a prior art burr-free method of forming the rubber material member.

After the rubber forming material is solidified to form the rubber material member 2, the mold is opened to take the rear holder α out, as shown by the arrow in FIG. 4C.

In this producing method, the rubber floating portion 1*d*, in which the rear portion 2*b* of the rubber material member 2 is formed, is only provided with the insertion hole forming pins 3*b*1 of the movable mold 3*b*. Thus, short shots can be prevented, because rubber forming material flows smoothly in the rubber floating portion 1*d*. Also, the production of the metal mold is easier and less expensive, as only one gate is necessary for introducing the rubber forming material.

Figures 2A, 2B, 2C, 2D, 2E:
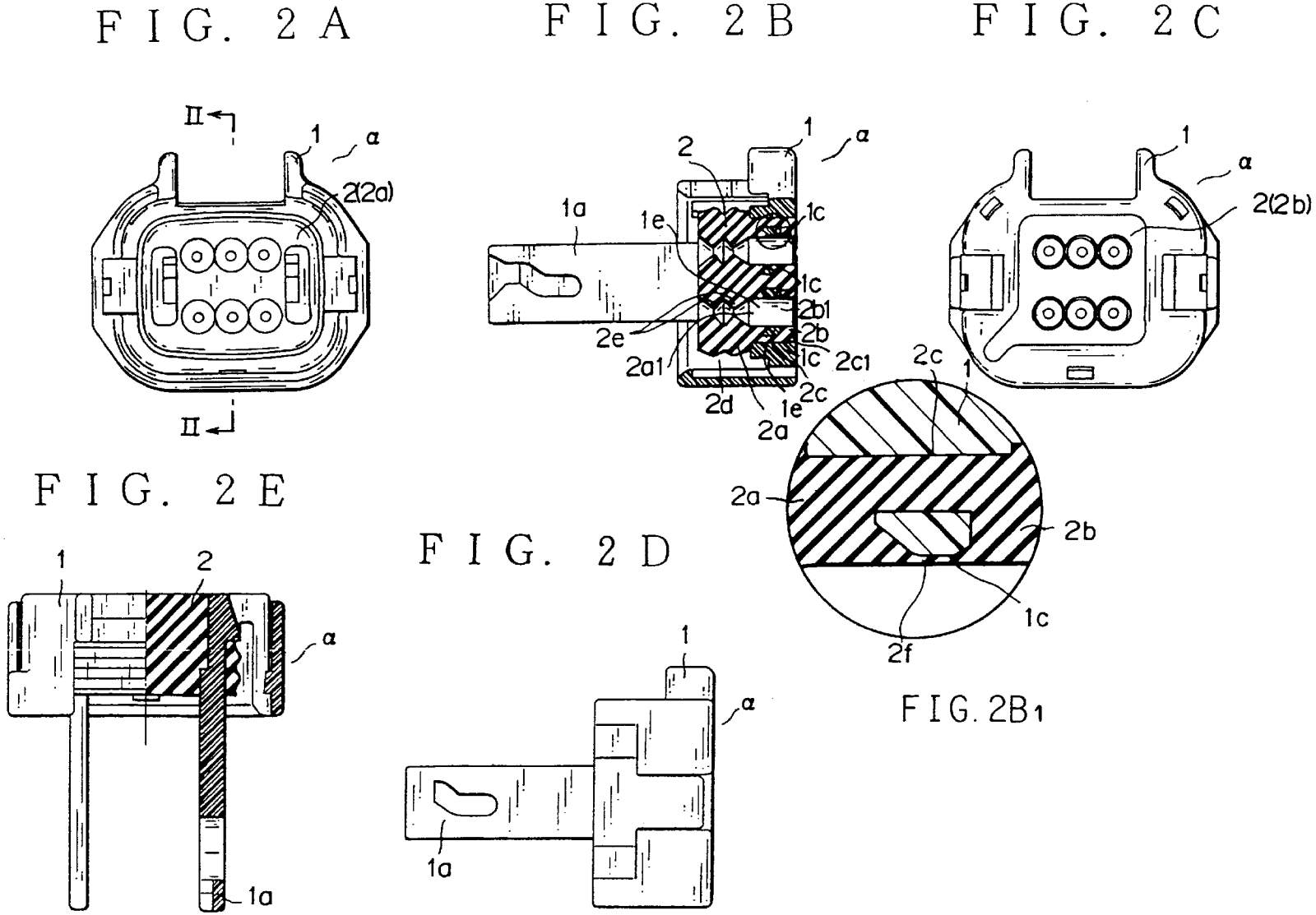
FIG. 2A shows a rear holder α for a water proof connector of the present invention as seen from a mating connector.
FIG. 2B is a sectional view taken along the line II—II of FIG. 2A.
FIG. 2C shows the rear holder α as seen from the terminal insertion side.
FIG. 2D is a side view of the rear holder α.
FIG. 2E is a partially sectional top view of the rear holder α.

The outer diameter of the insertion hole forming pins 3*b*1 provided to the rubber material member forming metal mold 3*b* is smaller than the inner diameter of each holder insertion hole 1*e* of the resin material member 1, so the rubber forming material enters the cavities formed between the insertion hole forming pins 3*b*1 and forms the thin rubber layers 2*f* connecting the rubber material member front portion 2*a* to the rear portion 2*b* inside each holder terminal insertion hole 1*e*, as shown in FIG. 2B. Thus, the inner wall of each holder terminal insertion hole 1*e* is covered with the rubber layer 2*f*, which connects the front portion 2*a* to the rear portion 2*b* of the rubber material member 2.

By doing so, the process to form a structure to prevent the rubber forming material from entering the inner wall of the holder terminal insertion holes 1*e* can be omitted, and the metal mold production costs can be reduced. Also, the rubber layers 2*f* secures better workability in terminal insertion, as there is no unconnected portion on the inner wall of the terminal insertion hole.

As described so far, the present invention provides the rear holder for a waterproof connector, which causes no short shots, and the metal mold for forming the rear holder is easier than in the prior art.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A rear holder for a waterproof connector, comprising:

the rear holder having an end face including a plate-shaped holding member made of resinous material having a surface parallel to the end face of the rear holder;

holder terminal insertion holes and holder connecting holes, both penetrating through said plate-shaped holding member;

a rubber member consisting of a front portion, a rear portion, and a connecting portion in the form of a thin rubber layer which covers the inner wall of each holder terminal insertion hole, said front portion and said rear portion being connected by said connecting portion that penetrates through said holder connecting holes of said plate-shaped holding member, a front end surface of the front portion of the rubber member being flush with a front end surface of the rear holder; and front rubber member terminal insertion holes and rear rubber member terminal holes penetrating through said front portion and said rear portion, respectively, and communicating with said holder terminal insertion holes of said plate-shaped holding member.

2. The rear holder for a waterproof connector according to claim 1, wherein each holder terminal insertion hole is provided with a guide portion for guiding a terminal thereinto.

3. The rear holder for a waterproof connector according to claim 2, wherein each holder terminal insertion hole is provided with a thin rubber layer which covers the inner wall thereof and connects said front portion to said rear portion of said rubber material member.

* * * * *